US006059215A

United States Patent [19]

Finnis

[11] Patent Number: 6,059,215

[45] Date of Patent: May 9, 2000

[54] HOSE RACK FOR A PIER PYLON

[76] Inventor: Stephen H. Finnis, P.O. Box 600, Dillon, Colo. 80435

[21] Appl. No.: 09/205,218

[22] Filed: Dec. 4, 1998

[51] Int. Cl.[7] ..... B65H 75/44

[52] U.S. Cl. ..... 242/400.1; 248/75; 248/79; 248/89

[58] Field of Search ..... 242/400.1; 137/355.12; 248/75, 76, 77, 78, 79, 80, 89, 90

[56] References Cited

U.S. PATENT DOCUMENTS

| | | | |
|---|---|---|---|
| 608,651 | 8/1898 | Cliff . | |
| 1,045,069 | 11/1912 | Nuhring . | |
| 1,870,322 | 8/1932 | Brown . | |
| 2,434,140 | 1/1948 | Bernstein . | |
| 2,453,248 | 11/1948 | Much . | |
| 2,876,976 | 3/1959 | Browning . | |
| 3,029,933 | 4/1962 | Sutter . | |
| 4,436,267 | 3/1984 | Eads et al. | 248/75 |
| 4,660,782 | 4/1987 | Hegemann . | |
| 5,601,263 | 2/1997 | Thayer | 248/75 |
| 5,699,987 | 12/1997 | Romaneschi et al. | 248/89 |

FOREIGN PATENT DOCUMENTS

| | | | |
|---|---|---|---|
| 2559045 | 8/1985 | France | 248/89 |

*Primary Examiner*—Donald P. Walsh
*Assistant Examiner*—William A. Rivera
*Attorney, Agent, or Firm*—Edwin H. Crabtree; Ramon L. Pizarro; Donald W. Margolis

[57] ABSTRACT

A hose rack for mounting around a portion of a round wood pier pylon. The hose rack adapted for receiving various sizes and lengths of a water hose. The water hose used for cleaning and maintenance around a boat and the boat dock. The hose rack includes a hose receiving saddle. The saddle has a semi-circular saddle base with a first side, a second side, a first end and a second end. The first side of the saddle base is attached to a front side of a concave shaped rack mounting bracket. A back side of the mounting bracket is adapted for conforming to and engaging the portion of the round pier pylon. The mounting bracket includes wood screw openings therethrough for receiving wood screws or the like for securing the hose rack to the pier pylon. The hose rack also includes a hose retaining bracket. The hose retaining bracket has a front side and a back side. The back side of the hose retaining bracket is attached to the second side of the saddle base. The hose retaining bracket includes a hole therein for receiving a portion of a screw driver therethrough when the screw driver is used for engaging a wood screw for securing the hose rack to the pylon. The hose rack is made of a flexible hard plastic and is dimensioned for engaging and wrapping around pylons, posts and the like and having different diameters.

12 Claims, 1 Drawing Sheet

HOSE RACK FOR A PIER PYLON

BACKGROUND OF THE INVENTION (a) Field of the Invention

This invention relates to devices for receiving and holding water hoses and the like thereon, and more particularly, but not by way of limitation, to a hose rack for mounting on a portion of a round wood pylon. The wood pylon may be a pier pylon used with a boat dock or may be a pylon or post used in other types of building structures.

(b) Discussion of Prior Art

In U.S. Pat. No. 4,660,782 to Hagemann, a portable reel with a non-rotatable spool and a rotatable spindle is described. One end of the spindle has a guide for holding a garden hose thereon. In U.S. Pat. No. 4,436,267 to Eads et al., a hose hanger is illustrated for mounting on a vertical wall. The hose hanger has a one-piece molded plastic construction and is adapted for coiling a garden hose thereon. In U.S. Pat. No. 608,651 to Cliff and U.S. Pat. No. 1,045,069 to Nuhring, different types of hose racks or hose supports are described having a collar or clamp adapted for supporting the racks or supports on a vertical pipe. In U.S. Pat. No. 1,870,322 to Brown, a hose rack is described for holding a fire hose. The rack includes a hinge and clamp for mounting the hose rack on a vertical pipe.

None of the above mentioned prior art hose racks and hose supports are designed for specifically engaging and attachment to a pier pylon.

SUMMARY OF THE INVENTION

In view of the foregoing, it is a primary object of the subject invention to provide a hose rack that is adapted for mounting on and around a portion of a wood pylon. The pylon used in the construction of a boat dock and the like.

Another object of the hose rack is the rack includes a saddle for receiving various sizes and lengths of water hose thereon.

Still another object of the invention is the hose rack is simple in design, made of hard plastic for durability, is flexible and is dimensioned for engaging and wrapping around pylons and posts having different diameters.

The subject invention includes a hose receiving saddle. The saddle has a semi-circular saddle base with a first side, a second side, a first end and a second end. The first side of the saddle base is attached to a front side of a concave shaped rack mounting bracket. A back side of the mounting bracket is adapted for conforming to and engaging the portion of the round pier pylon. The mounting bracket includes wood screw openings therethrough for receiving wood screws or the like for securing the hose rack to the pier pylon. The hose rack also includes a hose retaining bracket. The hose retaining bracket has a front side and a back side. The back side of the hose retaining bracket is attached to the second side of the saddle base. The hose retaining bracket includes a hole therein for receiving a portion of a screw driver therethrough when the screw driver is used for engaging a wood screw for securing the hose rack to the pylon.

These and other objects of the present invention will become apparent to those familiar with the different types hose racks and hose supports when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which:

FIG. 1 is a perspective view of the subject hose rack mounted on a portion of a pier pylon. The pylon is shown as part of the construction of a boat dock. The hose rack is illustrated with a water hose wrapped around a hose receiving saddle.

FIG. 2 is a side view of the hose rack shown attached to the pylon with the water hose shown in dashed lines and received around the saddle of the hose rack.

FIG. 3 is a top view of the hose rack shown attached to a portion of the pier pylon. In this view, the hose receiving saddle is shown attached to the front of a rack mounting bracket and attached to the rear of a hose retaining bracket.

FIG. 4 is a front view of the hose rack with the rack mounting bracket secured to the side of the pier pylon using wood screws or the like.

DESCRIPTION OF THE PREFERRED EMBODIMENTS

Figures 1, 2, 3, 4:
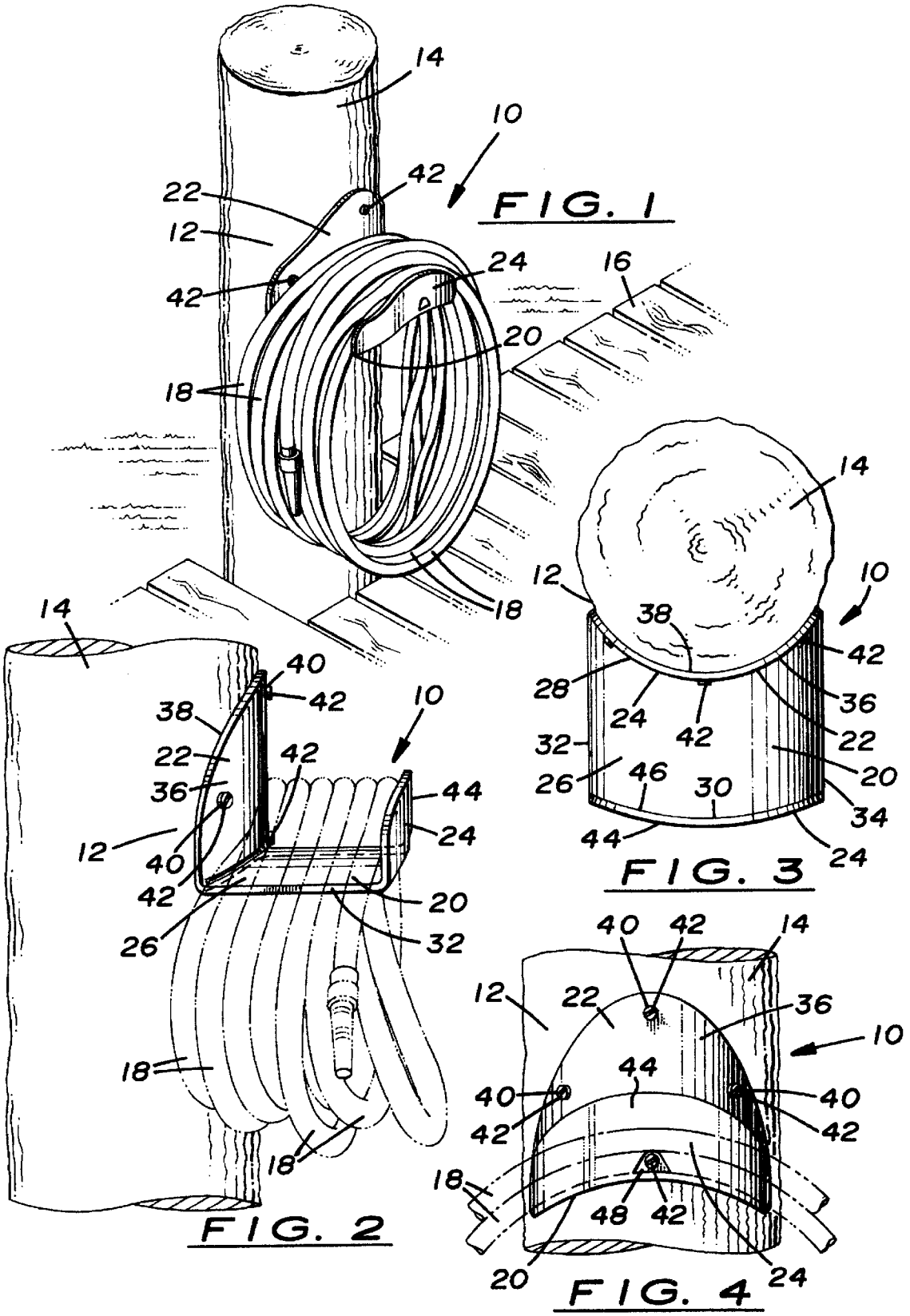

In FIG. 1, a perspective view of the subject hose rack is illustrated having general reference numeral 10. The hose rack 10 is shown mounted on a side of a round portion 12 of a pier pylon 14. The pylon 14 is part of the construction of a boat dock 16. While the pylon 14 is shown in the drawings, it should be kept in mind that the subject invention can be used equally well for mounting on a post, a tree and similar items having a round circumference.

In this drawing, the hose rack 10 is illustrated with a water hose 18 wrapped around a hose receiving saddle 20. The hose rack 10 includes broadly the hose receiving saddle 20, a concave shaped rack mounting bracket 22 and a hose retaining bracket 24. This structure is seen more clearly in FIGS. 2, 3 and 4.

In FIGS. 2 and 3, a side view and a top view of the hose rack 10 is shown attached to the pylon 14. The water hose 18 is shown in FIG. 2 in dashed lines and received around the hose receiving saddle 20. The saddle 20 includes a semi-circular saddle base 26 with a first side 28, a second side 30, a first end 32 and a second end 34. The first side 28 of the saddle base 26 is attached to a bottom of a front side 36 of the concave shaped rack mounting bracket 22. A back side 38 of the mounting bracket 22 is designed and adapted for conforming to and engaging the round portion 12 of the pier pylon 14.

In FIGS. 1 and 2, the water hose 18 can be seen wrapped around the top of the saddle base 26 from the first end 32 to the second end 34 and suspended from the saddle base 26. A portion of the coils of the water hose 18 are received on the saddle base 26 and held between the hose retaining bracket 24 and the mounting bracket 22 when the water hose 18 is not in use and in a stored position.

In the drawings, the mounting bracket 22 is seen with a plurality of wood screw openings 40 therethrough for receiving wood screws 42 or the like for securing the hose rack 10 to the pier pylon 14. The hose retaining bracket 24 includes a front side 44 and a back side 46. The bottom of the back side 46 of the hose retaining bracket 24 is attached to the second side 30 of the saddle base 26.

In FIG. 4, a front view of the hose rack 10 is shown and mounted on the pier pylon 14. In this view, the hose retaining bracket 24 can be seen with a hole 48 therein for receiving a portion of a screw driver therethrough when the screw driver is used for engaging a wood screw 42 for securing the hose rack 10 to the pylon 16.

The hose rack 10 may be made of a flexible hard plastic and like materials and the concave shaped rack mounting bracket 22 is dimensioned for engaging and wrapping around pylons, posts and the like and having different diameters for example in the range of 8 to 12 inches and greater.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

What is claimed is:

1. A hose rack for mounting around and attaching to a portion of a pylon or a similar annular shaped mounting post, the hose rack adapted for receiving various sizes and lengths of a water hose thereon, the hose rack comprising:

a hose receiving saddle, said saddle having a saddle base with a concave shaped first side, a concave shaped second side, a first end and a second end;

an upright concave shaped rack mounting bracket, the concave shaped first side of said saddle base attached to a front side of said concave shaped rack mounting bracket, a back side of said mounting bracket adapted for conforming to and engaging the portion of the pylon; and an upright concave shaped hose retaining bracket, said hose retaining bracket having a front side and a back side, the back side of said hose retaining bracket attached to the concave shaped second side of said saddle base;

whereby said retaining bracket with concave shape and said mounting bracket with concave shape are parallel to each other and provide a wrap around design, the wrap around design adapted for holding the water hose close to the pylon.

2. The hose rack as described in claim 1 wherein said saddle base in semi-circular in shape.

3. The hose rack as described in claim 1 wherein said concaved shaped mounting bracket includes wood screw openings therethrough, said wood screw openings adapted for receiving wood screws when securing the hose rack to the pylon.

4. The hose rack as described in claim 1 wherein said hose retaining bracket includes a hole therein, said hole adapted for receiving a portion of a screw driver therethrough when the screw driver is used for engaging a wood screw when securing the hose rack to the pylon.

5. The hose rack as described in claim 1 wherein said concaved shaped rack mounting bracket is made of a flexible hard plastic and is dimensioned for engaging and wrapping around pylons and posts, said mounting bracket adapted for receiving different diameters of pylons and posts in a range of 8 to 12 inches and greater.

6. A hose rack for mounting around and attached to a portion of a pylon or a similar annular shaped mounting post, the hose rack adapted for receiving various sizes and lengths of a water hose thereon, the hose rack comprising:

a hose receiving saddle, said saddle having a semi-circular saddle base with a concave shaped first side, a concave shaped second side, a first end and a second end;

an upright concave shaped rack mounting bracket, the concave shaped first side of said saddle base attached to a front side of said concave shaped rack mounting bracket, a back side of said mounting bracket adapted for conforming to and engaging the portion of the pylon; and an upright concave shaped hose retaining bracket, said hose retaining bracket having a front side and a back side, the back side of said hose retaining bracket attached to the concave shaped second side of said saddle base;

whereby said retaining bracket with concave shape and said mounting bracket with concave shape are parallel to each other and provide a wrap around design, the wrap around design adapted for holding the water hose close to the pylon.

7. The hose rack as described in claim 2 wherein said mounting bracket includes wood screw openings therethrough and adapted for receiving wood screws when securing the hose rack to the pylon.

8. The hose rack as described in claim 2 wherein said hose retaining bracket includes a hole therein and adapted for receiving a portion of a screw driver therethrough when the screw driver is used for engaging a wood screw when securing the hose rack to the pylon.

9. The hose rack as described in claim 2 wherein the hose rack is made of a flexible hard plastic and said rack mounting bracket is dimensioned for engaging and wrapping around the pylon having diameters in a range of 8 to 12 inches and greater.

10. A hose rack for mounting around and attached to a portion of a pylon or a similar annular shaped mounting post, the hose rack adapted for receiving various sizes and lengths of a water hose thereon, the hose rack comprising:

a hose receiving saddle, said saddle having a semi-circular saddle base with a concave shaped first side, a concave shaped second side, a first end and a second end;

an upright concave shaped rack mounting bracket, the concave shaped first side of said saddle base attached to a front side of said concave shaped rack mounting bracket, a back side of said mounting bracket adapted for conforming to and engaging the portion of the pylon, said mounting bracket having spaced apart openings therethrough for receiving fasteners for securing said mounting bracket to the pylon; and an upright concave shaped hose retaining bracket, said hose retaining bracket having a front side and a back side, the back side of said hose retaining bracket attached to the concave shaped second side of said saddle base;

whereby said retaining bracket with concave shape and said mounting bracket with concave shape are parallel to each other and provide a wrap around design, the wrap around design adapted for holding the water hose close to the pylon.

11. The hose rack as described in claim 10 wherein said hose retaining bracket includes a hole therein and adapted for receiving a portion of a screw driver therethrough when the screw driver is used for engaging a wood screw when securing the hose rack to the pylon.

12. The hose rack as described in claim 11 wherein the hose rack is made of a flexible hard plastic and said rack mounting bracket is dimensioned for engaging and wrapping around pylons and posts having diameters in a range of 8 to 12 inches and greater.

* * * * *